US006913385B1

(12) United States Patent
Sagos

(10) Patent No.: US 6,913,385 B1
(45) Date of Patent: Jul. 5, 2005

(54) SWIMMING POOL STORAGE DEVICE

(76) Inventor: Steve Sagos, 21 Cornell La., Hicksville, NY (US) 11801

( * ) Notice: Subject to any disclaimer, the term of this patent is extended or adjusted under 35 U.S.C. 154(b) by 82 days.

(21) Appl. No.: 10/351,864

(22) Filed: Jan. 27, 2003

(51) Int. Cl.[7] ..... B65D 33/01
(52) U.S. Cl. ..... 383/23
(58) Field of Search ..... 4/500; 383/23, 383/22, 13, 26, 102, 97

(56) References Cited

U.S. PATENT DOCUMENTS

| | | | | |
|---|---|---|---|---|
| 403,535 | A | 5/1889 | Johnson | |
| 1,072,022 | A | 9/1913 | Miller | |
| 1,284,579 | A | 11/1918 | Brown | |
| 2,507,842 | A * | 5/1950 | Waddill | 224/560 |
| 2,831,598 | A | 4/1958 | Slavsky et al. | |
| 3,456,865 | A * | 7/1969 | Frank | 383/13 |
| 3,955,727 | A | 5/1976 | Montgomery | |
| 5,076,711 | A * | 12/1991 | Koehler, Jr. | 383/67 |
| 5,092,487 | A | 3/1992 | Richer et al. | |
| 5,092,682 | A * | 3/1992 | Fenick | 383/22 |
| 5,294,194 | A | 3/1994 | Lombardo | |
| 6,116,438 | A | 9/2000 | Lovett | |
| 6,241,207 | B1 | 6/2001 | Powell | |
| 6,412,676 | B1 | 7/2002 | Stallings | |
| 6,606,752 | B2 * | 8/2003 | Marbach | 4/500 |

* cited by examiner

*Primary Examiner*—Stephen J. Castellano
(74) *Attorney, Agent, or Firm*—Michael I. Kroll

(57) ABSTRACT

A swimming pool storage device is disclosed configured for receiving toys, floats, sports equipment, and other devices associated with swimming pools. The device includes a casing and a plurality of clips. The casing includes a top wall, a bottom, a first side wall, a second side wall, a front wall, and a back wall. The casing is a waterproof shell having a waterproof zipper positioned across the top and at least a portion of the side walls to provide easy access into the interior of the casing. The bottom includes a plurality of holes for drainage and ventilation.

1 Claim, 8 Drawing Sheets

SWIMMING POOL STORAGE DEVICE

BACKGROUND OF THE INVENTION

1. Field of the Invention

The present invention relates generally to containers and, more specifically, to storage devices that are attachable to rails or edges such as those defined by a wall of an above ground swimming pool.

2. Description of the Prior Art

There is a long history of other devices configured for storing items which have issued patents. These devices range back in history from portable combined storage and display cases to hand carried configurations for carrying pool maintenance equipment.

A combined sample-holder and box-pull is described. The sample may be clearly exposed to view and readily attached or detached without interfering in any manner with the box cover. The sample-holder includes a case preferably made of tin provided with a glass front having in combination therewith an interior upwardly-projecting tongue constructed to hold a sample and a clasp to engage a box.

A garbage receptacle is described including a body having an open top, sides, and an open top having an automatic closure. The receptacle has an opening at one side. The body is provided with a bottom which inclines down toward the lower edge of the opening. A section is hingedly connected with the body at the lower edge of the inclined bottom and provided with side flanges. The flanges are adapted to lie against the sides of the body when the section is in the closed position over the side opening. A catch is adapted to hold the section in a closed position.

A jar or bottle holder having a body comprising a single strand of wire bent at one end to form a hook. The wire is coiled at one end of the book and extends downwardly to form one corner brace and bent to form a horizontal substantially U-shaped loop at the lower terminal of the downwardly extending portion to form a bottom for the holder. The wire extends upwardly from the bottom parallel to the downwardly extending portion and is spaced there from. The wire is further bent to extend across from the upper end of one parallel portion to the other, and pass through said first named coil, bent to form an upper horizontal substantially U-shaped loop coiled about the connecting portion and finally bent to form a second hook. A brace wire connects the lower ends of the parallel portion. A wire mesh is secured to the strand of wire and forming front, back, and bottom for the holder.

An auxiliary merchandise basket is described configured for the positioning of merchandise in a store. The basket is defined by heavy wire elements forming a box-like shape with sides and a bottom. The wires are preferably welded together. The basket has adjustable means adapted to position the basket relative to a supporting fixture and thereby adjust the basket to a level position.

A carrier bag adapted for positioning on a bicycle, the bag includes an enclosure of semi-flexible material and a substantially rigid, three-dimensional frame configured to provide a defining structure for at least two walls of the bag. The defining structure is configured to carry the load of the received within the enclosure. Elements are attached to the frame and function to attach the bag to the bicycle. The load in the bag is thus transferred to the frame and from the frame to the elements and bicycle frame.

A combination receptacle and holding device adapted for positioning on a hand rail of a fence of a veranda. The receptacle has four walls forming a front, a back, and two sides. The front also forms the bottom. A top is hingedly connected to the back wall. The holding device includes a plate shaped member in juxtaposition with the back of the receptacle connected to a top plate positioned at a right angle to the plate shaped member. The top plate is configured for positioning over the hand rail. A bottom plate is connected to a bottom edge of the plate shaped member and is configured for receiving the bottom of the receptacle.

A catch container for retaining items such as cuttings, sawdust, or miscellaneous other materials wiped from the edge of a work surface is described including a receptacle structure, a mounting bracket adjustably attached to the receptacle structure, and a sloped surface descending toward the receptacle from the mounting bracket. The catch container is configured for mounting against the outside of a drawer, for example, and under a work surface so that the miscellaneous material swept from the work surface is received by the sloped surface of the catch container. The miscellaneous material is then gathered at a base of the slope in the container by gravity or with the assistance of the user without splashing or spillage.

A free standing pool accessory storage unit is described including a frame having an upper portion and a lower portion. The upper and lower portions have a rectilinear configuration suitable for stacking. The upper and lower portions are defined by a pair of elongated side bars and a pair of short end bars coupled together. The upper and lower portions are connected by four stanchions. A plurality of net assemblies is including with the accessory storage unit with each net assembly including four meshed nets having integral sleeves configured for receiving the stanchions of the frames. In addition, detachable sleeves of the meshed nets are configured for being positioned onto the interconnected horizontally oriented bars to assist in suspending the nets.

A one-piece frame or bracket type device configured for storing a pool cover. The frame is connected to a swimming pool and has an arcuate and semi-circular U-shape configured for receiving a pool cover which is rolled off of a pool. The one-piece frame is connected to an underside of a terminal end of a perimeter pool wall and forms a concave arcuate shape towards the pool suitable for receiving the pool cover. The pool cover is stored at least partially below the edge of the terminal end. In operation, a plurality of the frames is positioned around the circumference of the pool to store the pool cover.

A hand held carrier for carrying pool maintenance equipment is described including a support bar connected to a shoulder strap and a substantially flat and flexible panel. The shoulder strap includes a shoulder pad, a hose strap, and a buckle for adjusting the length of the strap. The hose strap is configured for retaining a coiled section of pool hose. The panel includes a plurality of pockets configured for accommodating items such as a skimmer net type device, pool brush, and a vacuum head. The panel is fabricated of vinyl coated polyester or another substantially water-resistant and substantially chemical resistant material.

While these storage devices may be suitable for the purposes for which they were designed, they would not be as suitable for the purposes of the present invention, as hereinafter described.

It is thus desirable, to provide a swimming pool storage device that can be readily positioned at any point along a side wall of an above ground swimming pool or a nearby supporting structure such as a porch or patio rail, for example, using at least two clips. The storage device defines a large opening for the positioning of pool related toys and equipment. A bottom of the storage device defines a plurality of holes for the drainage of water and the circulating of air. It is further desirable to provide a low cost waterproof easily manufactured swimming pool storage device.

SUMMARY OF THE PRESENT INVENTION

A swimming pool storage device comprising a plurality of clips adapted for connecting with a supporting structure. A casing is removably connected with the clips. The casing has a top wall, a bottom, a first side wall, a second side wall, a front wall, and a back wall. The top includes means for selectively opening and securing the casing that extends across the top and at least partially along the side walls. The means for opening and securing is configured for selectively defining an opening and providing a waterproof closure of the casing. The bottom defines a plurality of through holes, the walls and bottom being fabricated of a water proof material.

A primary object of the present invention is to provide a swimming pool storage device that is attachable to a wall of an above ground swimming pool.

Another object of the present invention is to provide a storage device that can accommodate and protect the ancillary devices associated with outdoor swimming pools.

Yet another object of the present invention is to provide a storage device having a body with spaced apart walls that engages the exterior wall of an above ground swimming pool.

Still yet another object of the present invention is to provide a storage device preferably having two generally U-shaped clips extending from the body and extending to engage the interior of the swimming pool.

Another object of the present invention is to provide a storage device wherein the clips engaging the interior of the swimming pool extend in a substantially U-shape and having spaced apart arms to accommodate various sized pool top rims.

Yet another object of the present invention is to provide a storage device having a plurality of spaced apart holes in the base of the housing to provide drainage and ventilation for the interiorly held items.

Yet another object of the present invention is to provide a storage device having a topmost means for access comprised of a zipper extending from one side wall of the device to the other side wall of the device.

Still yet another object of the present invention is to provide a storage device that can easily be detached and stored elsewhere during winter months.

Yet another object of the present invention is to provide a storage device that is easy to manufacture.

Additional objects of the present invention will appear as the description proceeds.

The present invention overcomes the shortcomings of the prior art by providing a storage device that is attachable to the exterior wall of an above ground swimming pool having clips extending into the interior of the pool having U-shaped spaced apart members to accommodate pool lips of various sizes. The body of the storage device has spaced apart walls with a bottom having a plurality of apertures providing drainage and ventilation and a top most zipper proving access to the interior.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing figures in which.

Figure 1:
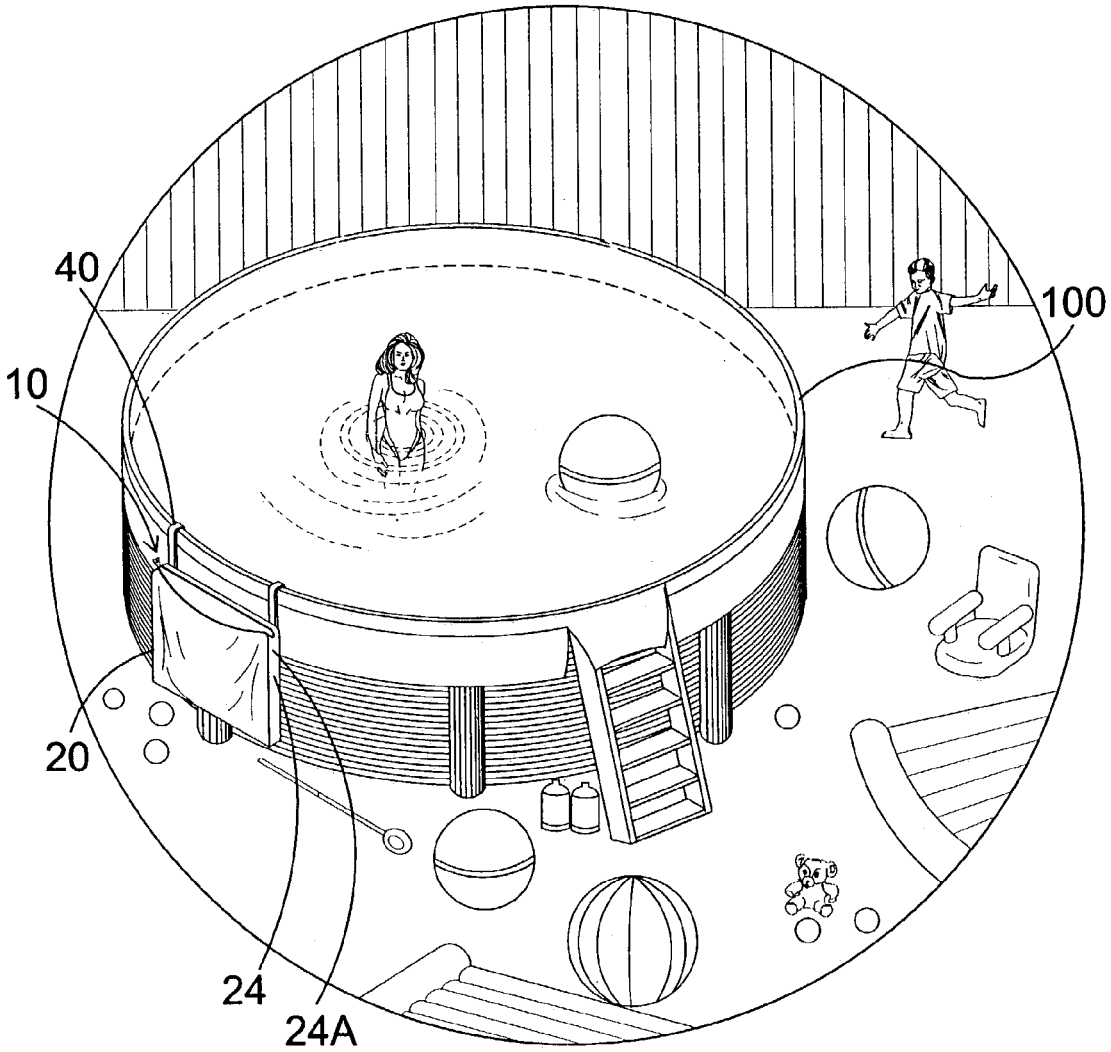
FIG. 1 is a frontal perspective view of a swimming pool storage device constructed in accordance with the present disclosure positioned on an above ground swimming pool.
Figure 2:
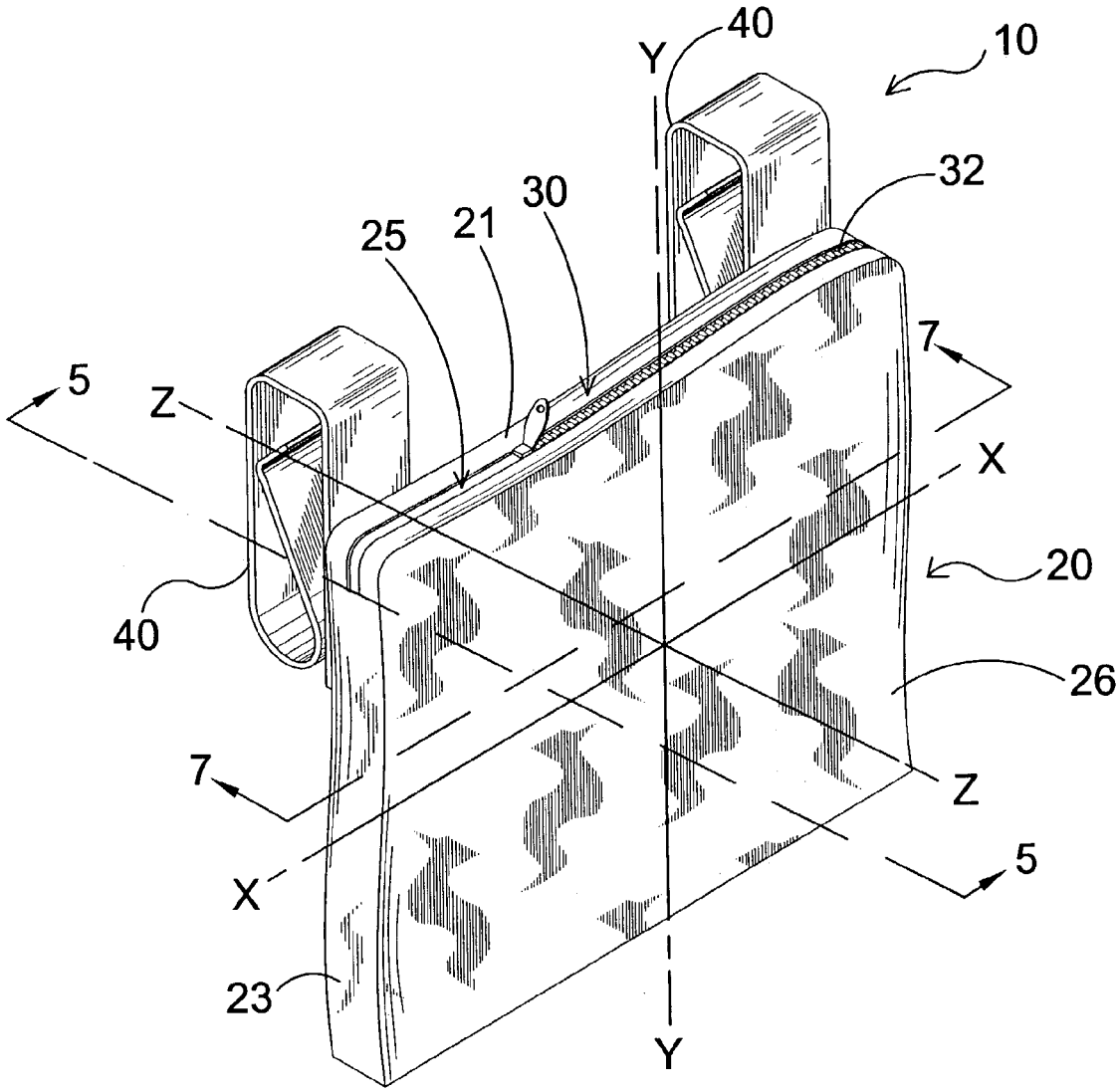
FIG. 2 is a frontal perspective view of the swimming pool storage device of FIG. 1 constructed in accordance with the present disclosure.
Figure 7:
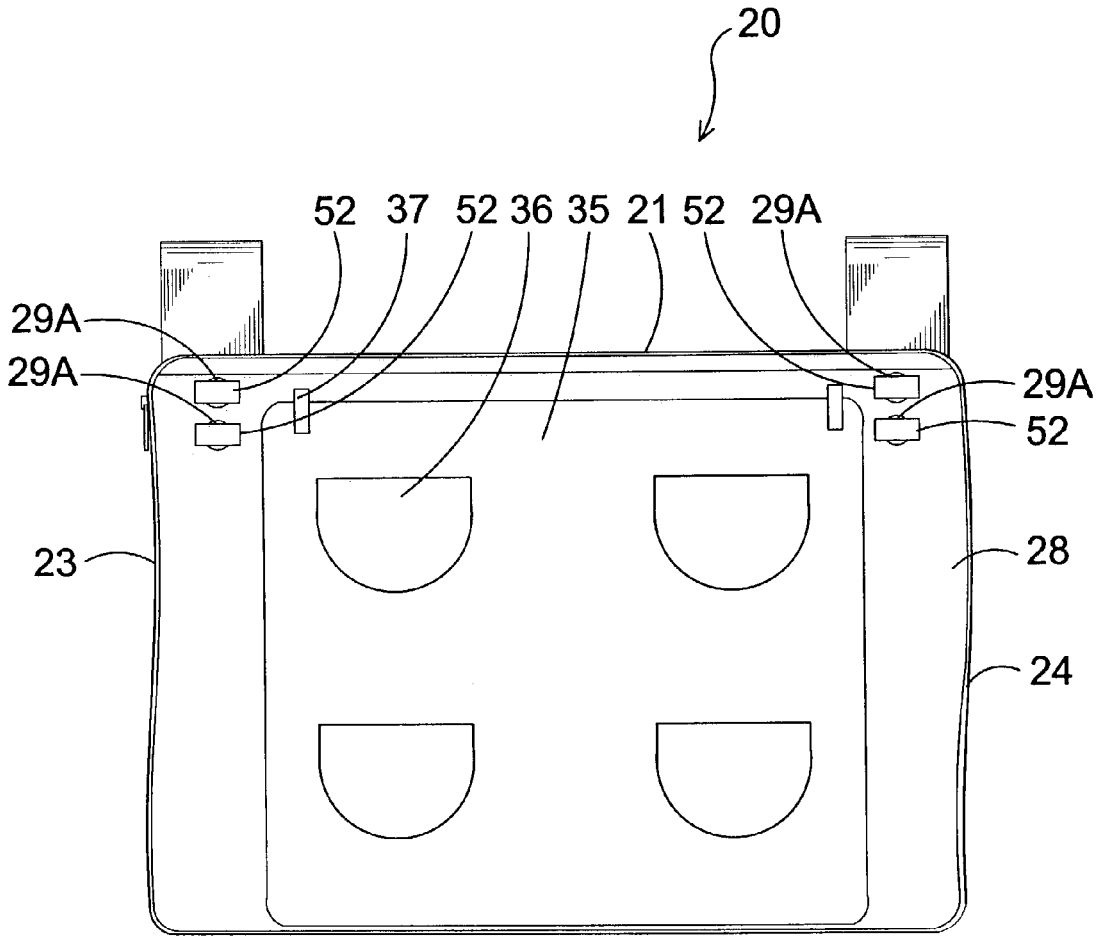
Figure 8:
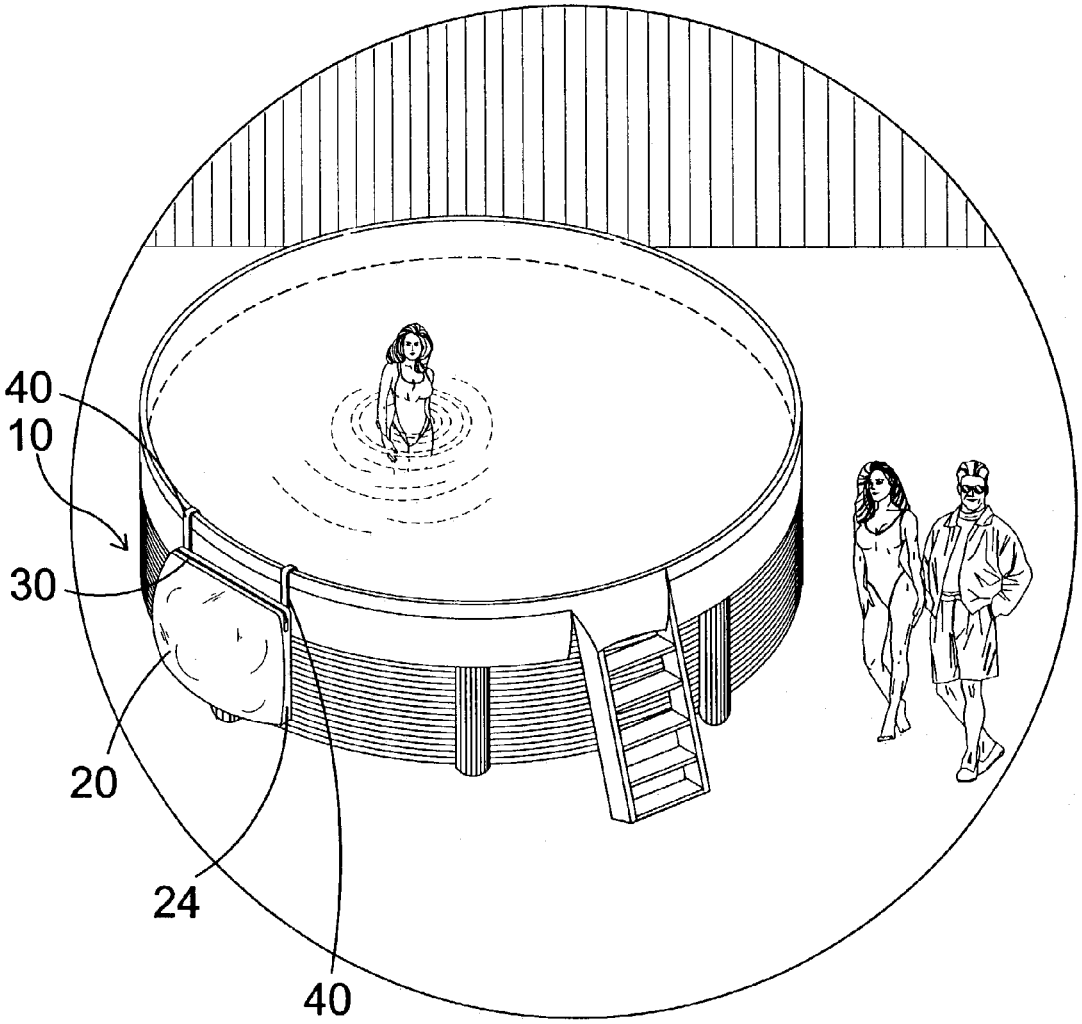

FIG. 7 is a cross-sectional frontal view of the swimming pool storage device viewed along lines 7—7 of FIG. 2 constructed in accordance with the present disclosure; and FIG. 8 is a frontal perspective view of the swimming pool storage device of FIG. 1 having the sports equipment, toys, and pool maintenance devices of FIG. 1 positioned therein and constructed in accordance with the present disclosure.

DESCRIPTION OF THE REFERENCED NUMERALS

Turning now descriptively to the drawings, in which similar reference characters denote similar elements throughout the several views, the figures illustrate the present invention. With regard to the reference numerals used, the following numbering is used throughout the various drawing figures.

10 swimming pool storage device
20 storage casing
21 top of the storage casing
22 bottom of storage casing
23 first side of storage casing
23A vent hole in first side
24 second side of storage casing
24A vent hole in second side
25 opening defined in top of storage casing
26 front of storage casing
27 plurality of holes defined in the bottom of storage casing
28 back of storage casing
29 receiving means

29A holes defined in back of storage casing as part of connecting means
30 means for selectively opening and securing the casing
32 zipper
35 dividers
36 pockets
37 hook and loop strips
40 plurality of clips
41 first side of the clip
42 top of the clip
43 second side of clip
44 first end of the clip
47 first bend of clip
48 second bend of clip
49 second end of clip
50 connecting means
52 T-element attachment devices of connecting means
100 above ground swimming pool
110 wall of above ground swimming pool
112 top edge and/or cap of wall of above ground swimming pool

DETAILED DESCRIPTION OF EXEMPLARY EMBODIMENTS OF THE INVENTION

The following discussion describes in detail preferred embodiments of the invention. This discussion should not be construed, however, as limiting the invention to those particular embodiments, practitioners skilled in the art will recognize numerous other embodiments as well. For definition of the complete scope of the invention, the reader is directed to appended claims.

Referring now in specific detail to the drawings in which like referenced numerals identify similar or identical elements throughout the several views, and initially to FIG. 1, a novel swimming pool storage device 10 is shown. Swimming pool storage device 10 includes a casing 20 and clips 40 adapted for use with an above ground swimming pool 100.

Figure 3:
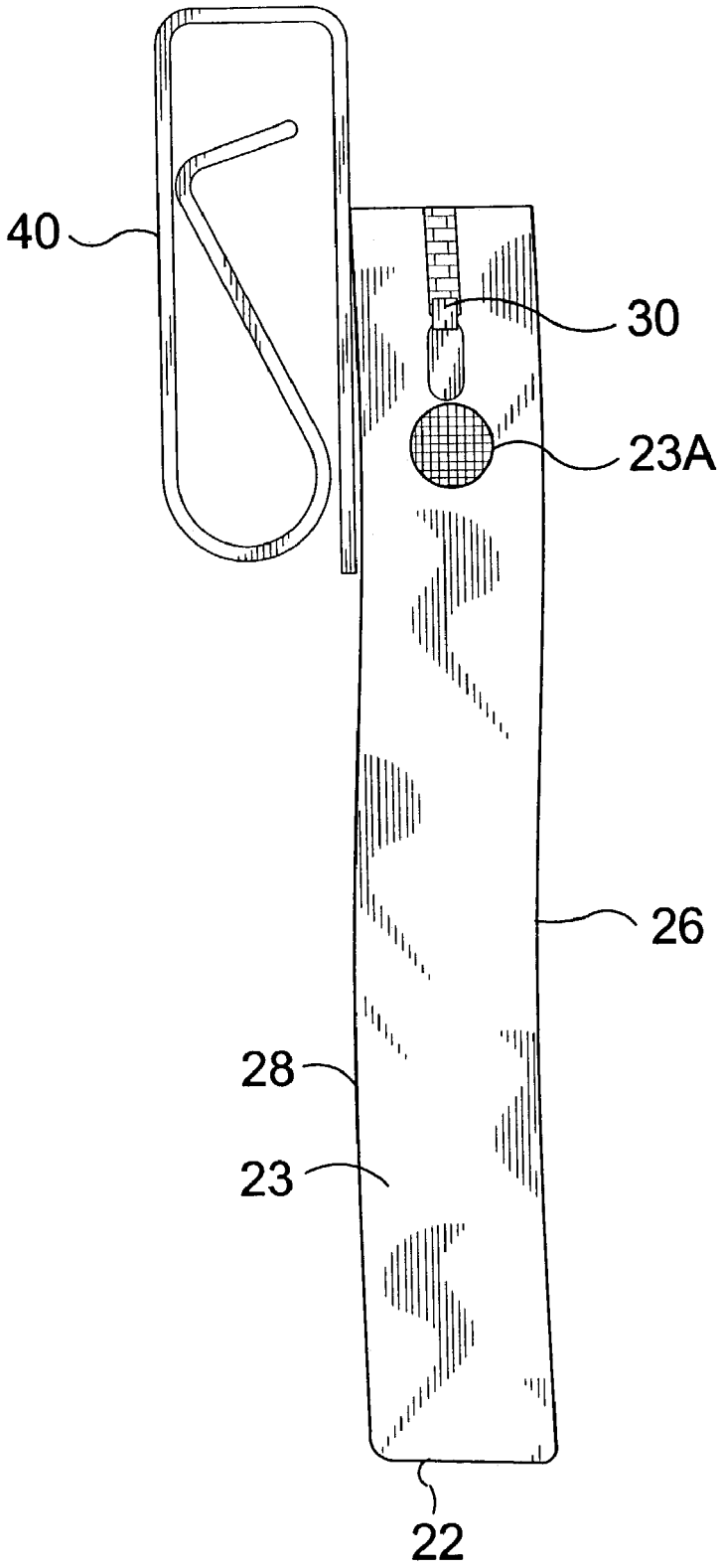
FIG. 3 is a side view of the swimming pool storage device of FIG. 1 constructed in accordance with the present disclosure.

Referring now to FIGS. 1–3, casing 20 in this one preferred embodiment of swimming pool storage device 10 includes a top wall 21, a bottom wall 22, a first side 23, a second side 24, a front wall 26 and a back wall 28. Casing 20 is connected to clips 40 through back 28. While casing 20 is shown having generally opposing front and back as well as top and bottom walls, casing 20 defines an enclosure that can be any three dimensional shape. For example, front wall 26 can be convex extending outward from back 28 or sides 23 and 24 can be expandable to form a cube.

Casing 20 has an axis-X parallel with the intersection of the edges of face 26 with top 21 and bottom 22 and an axis-Y parallel with the edges of face 26 with sides 23 and 24. Axis-X is perpendicular to axis-Y and an axis-Z is perpendicular to and intersects axes X and Y.

Top 21 defines an opening or hole 25 parallel with axis-X selectively closeable by a watertight means for selectively opening and securing the casing 30. Means 30 is preferably a zipper 32, but can include other well known water proof mechanical attachment mechanisms such as, but not limited to, select hook and loop devices and snap-pressure fittings. Zipper 32 extends across the full length of top 21 parallel to axis-X and extends at least partially onto side 23 and side 24. Sides 23 and 24 can be solid or for example include vents 23A and 24A for a cross flow of ventilation.

Top 21, first side 23, second side 24, face 26, and back 28 are preferably fabricated of a flexible outdoor waterproof material such as a nylon, an air breathable waterproof fabric, or other suitable fabric having suitable structural integrity, flexibility, and strength for application as walls of casing 20. The walls of casing 20 form a three dimensional enclosure as shown having width, depth, and height based solely on its support from the plurality of clips 40. The material can be a relatively thin layer having a waterproof coating and reinforced edges, for example, or multiple layers of materials bonded. In addition, in one preferred embodiment the wall material is specifically configured for resistance to degrading when exposed for extended periods of time to sunlight.

In FIGS. 3 and 7, casing 20 is shown including dividers 35, pockets 36, and hook and loop strips 37. Hook and loop strips 37 can be positioned on one or more of dividers 35, pockets 36, and the inner surfaces of top 21, bottom 22, first side 23, second side 24, face 26, and back 28 for the organized storing of the toys, floats, athletic equipment, and/or maintenance devices for swimming pool 100.

Figure 4:
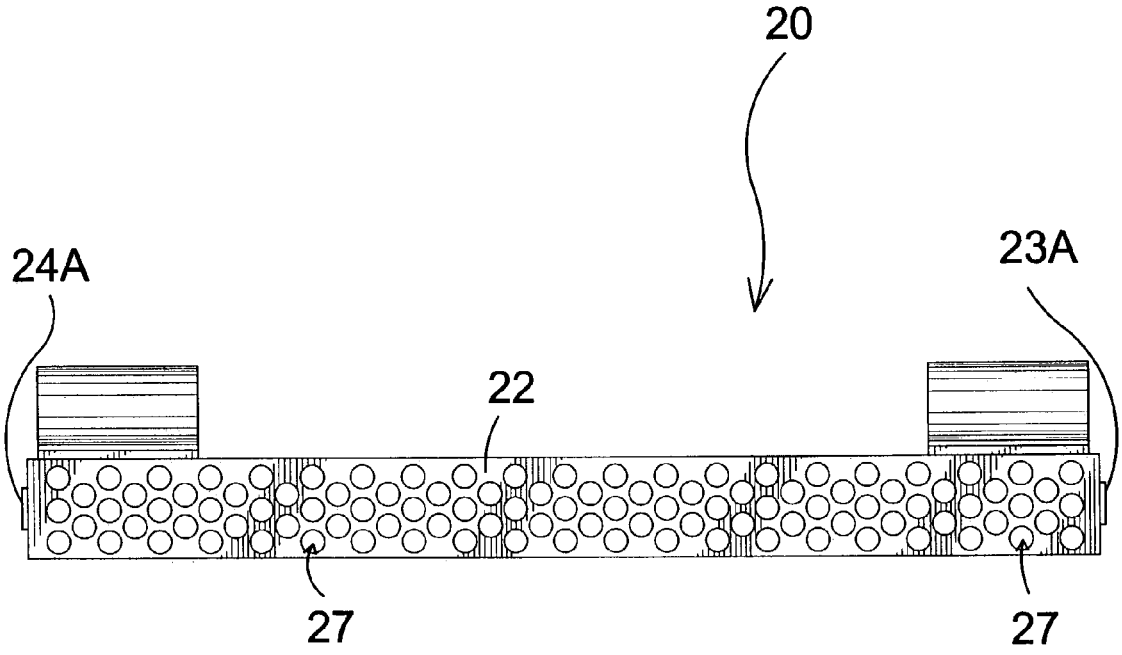
FIG. 4 is a bottom view of the swimming pool storage device of FIG. 1 constructed in accordance with the present disclosure.
Figure 5:
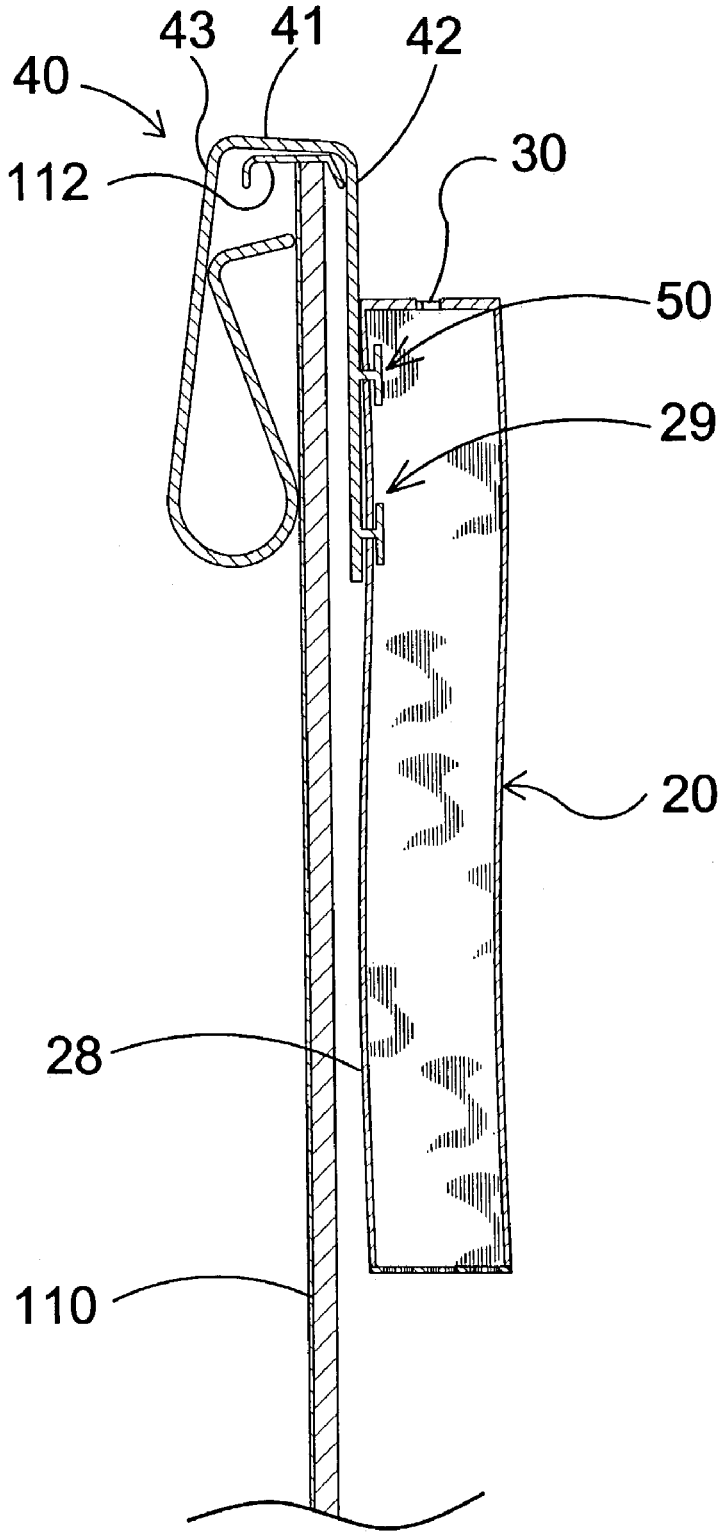
FIG. 5 is a cross-sectional side view of the swimming pool storage device viewed along lines 5—5 of FIG. 2 constructed in accordance with the present disclosure.
Figure 6:
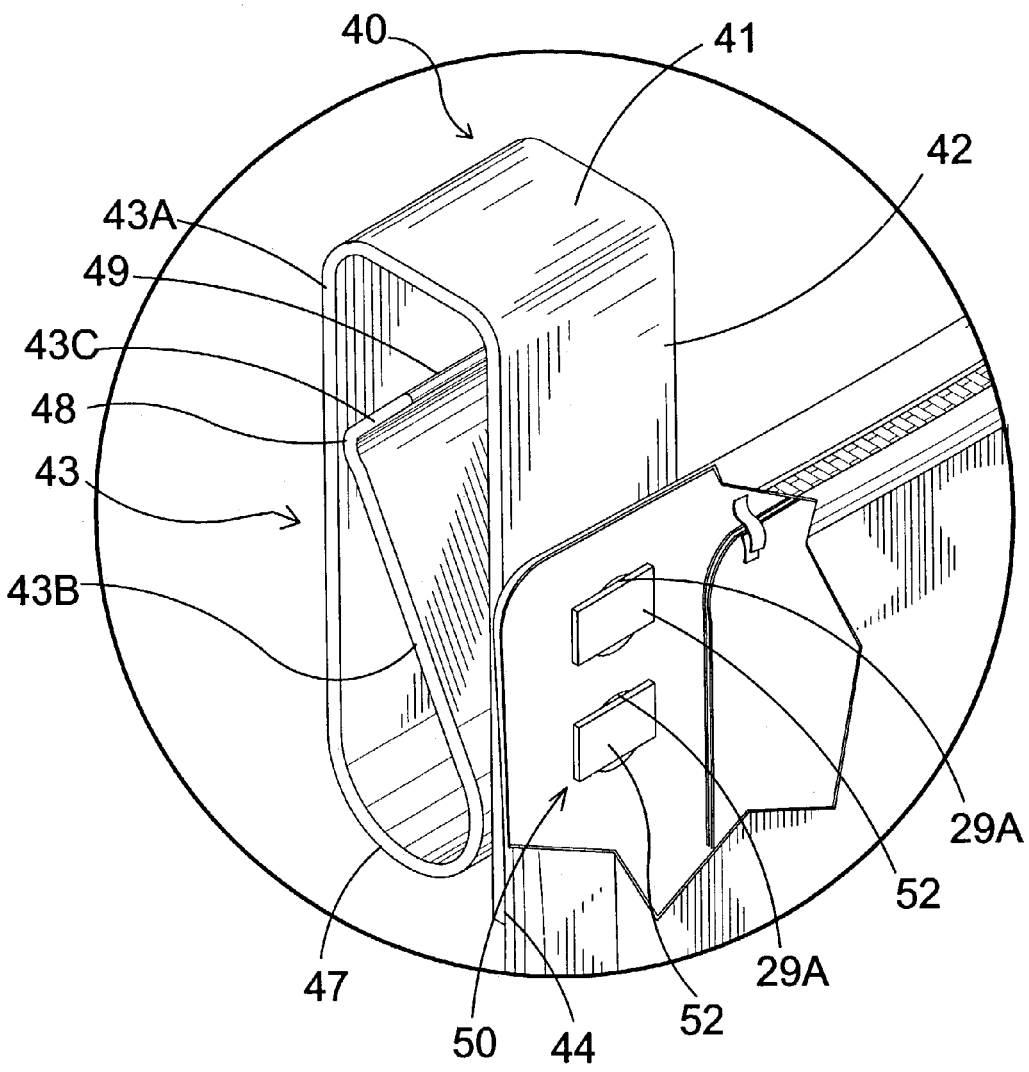
FIG. 6 is a close-up partial cut-away perspective view a corner of the casing of the swimming pool storage device of FIG. 1 constructed in accordance with the present disclosure.

Referring now to FIG. 4, bottom 22 defines a plurality of holes 27 configured as drainage holes and for air flow to prevent an accumulation of mildew. Holes 27 in combination with holes 23A and 24A of sides 23 and 24, respectively, also prevent a build of excessively hot air and moisture within casing 20. Bottom 22 can be made of the same fabric as the walls of casing 20 or be formed of a different material of suitable strength such as wood, plastic, metal, or composite.

In FIGS. 2 and 5–7, each of the plurality of clips 40 include a first portion 41, a second portion 42, and a third portion 43. The dimensions and configuration of clips 40 is suitably sized to accommodate a broad range of supporting structures such as those of walls 110 and top edges or caps 112 of above ground swimming pools. It is understood that references to walls 110 and caps 112 as used herein encompasses suitable supporting structures walls, fence rails, patio rails/walls, and deck rails/walls. At least two clips 40 are used to support casing 20.

In this one preferred embodiment, first portion 41 is configured as a base or supporting portion connecting second portion 42 and third portion 43. As shown, first portion 41 is positioned to directly interface with cap or top edge 112 of wall 110 and has sufficient length in the direction of axis-Z to encompass the width of edges 112 as well as patio and porch rails or walls.

Second portion 42 includes an end 44 and connecting means 50. Connecting means 50 is configured for attaching receiving means 29 positioned on back 28 of casing 20. Connecting means 50 can include attachment devices 52 such as hooks, tabs, or T-shaped elements. The T-elements, for example, can be configured as connectable threaded bolt and receiving portions or as fixed portions. Receiving means 29 preferably includes holes 29A defined in wall 28 configured for attaching with connecting means 50. Holes 29A can be reinforced, as required, to support the configured loads for storage device 10. Attachment devices 52 can extend across the length of the clip 40 along axis-X, be positioned as individual elements in one or more rows, or combinations thereof.

Third portion 43 functions to provide a bias mechanism in combination with first portion 41 and second portion 42. A first element 43A of third portion 43 extends generally downward from first portion 41 and forms a first bend 47 of over 180 degrees having an approximately tear drop shape such that a portion of first bend 47 is in direct contact with wall 110. An element 43B of third portion 43 extends from first bend 47 upward to a second bend 48 between wall 110 and first element 43A.

Second bend 48 of approximately 90 degree is approximately in juxtaposition with first element 43A. A third element 43C extends from second bend 48 to a terminal end 49 preferably positioned in direct contact with wall 110. The series of bends 47 and 48 in combination with end 49 and elements 43A, 43B, and 43C create a bias mechanism configured for securely attaching to and positioning on a supporting structure such as wall 110.

Clips 40 are preferably made of a plastic configured for outdoor applications and having suitable strength for application as a structural member. Clips 40 can be fabricated from a variety of materials including composites and metals. Clips 40 are configured for simplicity of installation and removal while providing a secure mechanism for attaching casing 20.

In operation, as shown initially in FIGS. 1 and 8, while swimming pools are a favorite source recreation for many, swimming pools are also often a source of clutter for the many pool related items such as, but not limited to toys, floats, sports equipment, and maintenance devices. Swimming pool storage device 10 is a readily attachable assembly advantageously positionable directly on swimming pool 100 for the convenient accommodation of storing pool related items.

Referring now to FIGS. 2, 5–6, and 8, clips 40 are positioned on wall 112 of swimming pool 100 without any bolts or other connecting devices in spaced relation with holes 29A of receiving means 29. Two or more clips 40 are typically used to support storage device 10 and any potential loads positioned within casing 20. Means for selectively opening and securing the casing 30, such as a zipper 32, is opened to define opening 25 of storage device 10 and holes 29A of receiving means 29 are aligned with and attached to attachment devices 52 of connecting means 50.

Storage device 10 can then be loaded with the pool related items and zipped closed to provide a waterproof outer covering. Holes 27 in bottom 22 provide drainage for any wet articles as well as a ventilation to prevent mildew. Additional vents 23A and 24A can be positioned to provide a cross flow.

Storage device 10 is disassembled by using the opening means for selectively opening and securing the casing 30 to open and remove the pool related items positioned therein. Casing 20 is detached from connecting means 50 of clips 40. Clips 40 can then be easily removed from the supporting structure. Casing 20, however, is configured for and can be used as a storage device throughout the year. When it is elected to dismantle swimming pool 100 and/or storage device 10, casing 20 can be folded or rolled for storage with clips 40 conveniently positioned inside. Alternatively, as desired, casing 20 can also be used as a detached in a loaded configuration as an off season storage device and positioned within a shed or garage, for example, retaining the various pool related items.

Although the illustrative embodiments of the present disclosure have been described herein with reference to the accompanying drawings, it is to be understood that the disclosure is not limited to those precise embodiments, and that various other changes and modifications may be affected therein by one skilled in the art without departing from the scope or spirit of the disclosure. All such changes and modifications are intended to be included within the scope of the disclosure.

What is claimed is:

1. A swimming pool storage device adapted for positioning on a wall of an above ground swimming pool comprising:

said swimming pool having a vertical wall;

a pair of clips positioned on and overlapping a top edge of said vertical wall;

a storage casing removably connected to the clips, the casing having a top wall, a bottom, a first side wall, a second side wall, a front wall, and a back wall, the top wall including a waterproof zipper for selectively opening and securing the casing, the zipper extending across the top wall and at least partially along the side walls, the side walls, front and back walls, and top wall of said casing being made of a flexible outdoor waterproof material, the side walls containing vents;

each clip comprising a top portion resting on said top edge of said wall, a rear spring portion extending along an inner surface of said wall, and a front portion extending outside of said wall;

a pair of T-shaped members extending from said front portion of said clip, said T-members engaging the back wall of said casing through openings thereof for supporting said casing on the outside of said wall;

said casing having an interior with dividers, pockets, and hook and loop straps; and the bottom of said casing being made of a rigid material containing drainage holes.

* * * * *